US008371052B2

(12) United States Patent
Boyles et al.

(10) Patent No.: US 8,371,052 B2
(45) **Date of Patent: *Feb. 12, 2013**

(54) ILLUMINATED SIGN

(75) Inventors: Chad Boyles, Pewaukee, WI (US); Beth Donnelly, Wauwatosa, WI (US); Robert Mathson, Pewaukee, WI (US)

(73) Assignee: Everbrite, LLC, Greenfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/350,488

(22) Filed: Jan. 13, 2012

(65) Prior Publication Data

US 2012/0110882 A1 May 10, 2012

Related U.S. Application Data

(63) Continuation of application No. 12/560,706, filed on Sep. 16, 2009, now Pat. No. 8,109,020.

(51) Int. Cl.
*G09F 13/04* (2006.01)

(52) U.S. Cl. ..... 40/576; 40/541; 40/553

(58) Field of Classification Search ..... 40/502, 40/495, 606.14, 606.15, 508, 531; 362/812, 362/282, 324, 322, 35

See application file for complete search history.

(56) References Cited

U.S. PATENT DOCUMENTS

| | | | |
|---|---|---|---|
| 335,130 | A | 2/1886 | Bloomer, Jr. |
| 1,570,980 | A | 1/1926 | Wiegand |
| 1,872,428 | A | 8/1932 | Drury |
| 1,917,956 | A | 7/1933 | Earley |
| 2,302,667 | A | 11/1942 | Duncan |
| 2,354,367 | A | 7/1944 | Duncan |
| D162,355 | S | 3/1951 | Smith |
| D162,637 | S | 3/1951 | Ernst |
| 2,556,779 | A | 6/1951 | Ross |
| 2,648,152 | A | 8/1953 | Simpsom |
| D188,174 | S | 6/1960 | Thomas |
| 3,056,221 | A | 10/1962 | Brienza |
| D196,703 | S | 10/1963 | Blommel, Jr. |
| 3,203,126 | A | 8/1965 | Eliot |
| 3,295,240 | A | 1/1967 | Garte |
| 3,340,631 | A | 9/1967 | Lyon et al. |
| 4,155,189 | A | 5/1979 | Engman |
| 4,169,327 | A | 10/1979 | Stilling |
| 4,201,003 | A | 5/1980 | Witt |
| 4,373,283 | A | 2/1983 | Swartz |
| 4,430,819 | A | 2/1984 | Chandler |
| 4,852,285 | A | 8/1989 | Kimoto |
| 4,854,062 | A | 8/1989 | Bayo |
| 4,862,616 | A | 9/1989 | Honeycutt |
| 4,953,067 | A | 8/1990 | Moore |
| 5,002,181 | A | 3/1991 | Leppo |

(Continued)

OTHER PUBLICATIONS

Exhibit A—Open Sign manufactured and sold by Everbrite, LLC at least as early as Dec. 7, 2007.

(Continued)

*Primary Examiner* — Casandra Davis
(74) *Attorney, Agent, or Firm* — Michael Best & Friedrich LLP

(57) ABSTRACT

An illuminated sign that includes a base configured to face a front direction and configured to be placed in a first orientation and a second orientation when the base faces the front direction. A first character is configured to rotate with respect to the base between a first position facing the front direction and a second position facing the front direction. A second character is configured to rotate with respect to the base between the first position facing the front direction and the second position facing the front direction. A rotation mechanism is configured to enable at least one of the first character and the second character to rotate between the first and the second positions.

20 Claims, 8 Drawing Sheets

U.S. PATENT DOCUMENTS

| | | | |
|---|---|---|---|
| 5,143,285 | A | 9/1992 | Wise |
| 5,146,704 | A | 9/1992 | Dugan |
| 5,237,765 | A | 8/1993 | Vargish, II |
| 5,267,404 | A | 12/1993 | Kizy |
| 5,493,804 | A | 2/1996 | Lo et al. |
| 5,533,286 | A | 7/1996 | Fallon et al. |
| 5,536,558 | A | 7/1996 | Shelton |
| 5,579,598 | A | 12/1996 | Fallon et al. |
| 5,649,379 | A | 7/1997 | Hoffman et al. |
| 5,687,939 | A | 11/1997 | Moscovitch |
| 5,890,306 | A | 4/1999 | Smith |
| 5,992,067 | A | 11/1999 | Strawbridge |
| 6,023,869 | A | 2/2000 | Durbin |
| 6,042,248 | A | 3/2000 | Hannah et al. |
| 6,050,716 | A | 4/2000 | Hsu |
| 6,076,294 | A | 6/2000 | Durbin |
| 6,094,849 | A | 8/2000 | Phillips et al. |
| D433,453 | S | 11/2000 | Fallon |
| D434,808 | S | 12/2000 | Andersson |
| 6,192,610 | B1 | 2/2001 | Fallon et al. |
| 6,205,691 | B1 | 3/2001 | Urda et al. |
| 6,341,441 | B1 | 1/2002 | Morales |
| D455,789 | S | 4/2002 | Schlueter |
| D456,850 | S | 5/2002 | Fallon |
| D460,490 | S | 7/2002 | Fallon |
| D461,846 | S | 8/2002 | Fallon |
| 6,460,277 | B1 | 10/2002 | Tower |
| 6,477,799 | B1 | 11/2002 | Erickson et al. |
| D477,032 | S | 7/2003 | Fallon |
| D484,916 | S | 1/2004 | Fallon |
| 6,675,515 | B2 | 1/2004 | Fallon et al. |
| D501,516 | S | 2/2005 | Nelson |
| D507,603 | S | 7/2005 | Nelson |
| D545,907 | S | 7/2007 | Nelson |
| D553,691 | S | 10/2007 | Lane |
| 7,327,281 | B2 | 2/2008 | Hutchison |
| D582,988 | S | 12/2008 | Donnelly et al. |
| D591,797 | S | 5/2009 | Donnelly |
| D599,410 | S | 9/2009 | Kaoh |
| D599,411 | S | 9/2009 | Kaoh |
| 2001/0027618 | A1 | 10/2001 | Fallon et al. |
| 2002/0145878 | A1 | 10/2002 | Venegas, Jr. |
| 2005/0223611 | A1* | 10/2005 | Dennis ..... 40/729 |
| 2006/0059742 | A1 | 3/2006 | Pan |
| 2006/0230657 | A1* | 10/2006 | Kotze ..... 40/454 |
| 2009/0172987 | A1 | 7/2009 | Kaoh et al. |
| 2010/0208464 | A1 | 8/2010 | Dalsgaard |

OTHER PUBLICATIONS

Exhibit B—Open Sign manufactured and sold by Everbrite, LLC at least as early as Dec. 7, 2007.

Exhibit C—Open Sign manufactured and sold by Everbrite, LLC at least as early as Dec. 7, 2007.

Exhibit D—Open Sign manufactured and sold by Everbrite, LLC at least as early as Dec. 7, 2007.

Gelcore LLC, Tetra Contour Data Sheet, Publication No. SIGN022, Valley View , Ohio, published Jun. 9, 2006.

* cited by examiner

ILLUMINATED SIGN

CROSS-REFERENCE TO RELATED APPLICATIONS

This application is a continuation application of U.S. patent application Ser. No. 12/560,706, filed Sep. 16, 2009, the entire contents of which are hereby incorporated by reference herein.

BACKGROUND

The present invention relates to illuminated signs.

Illuminated signs are often used in retail stores, restaurants, and the like. Illuminated signs can be used to relay messages to customers, such as whether the store or restaurant is open or closed for business. Alternatively, an illuminated sign can be used to display advertisements, promotions, sales, etc. Such signs are often illuminated by a light source that may include, light emitting diodes ("LED's"), neon lamps, incandescent light bulbs, or fluorescent light bulbs.

SUMMARY

In one embodiment, the invention provides an illuminated sign that includes a base configured to face a front direction and configured to be placed in a first orientation and a second orientation when the base faces the front direction. A light source is coupled to the base, and a translucent output is coupled to the base and is configured to transmit light generated by the light source. A first character is configured to be illuminated by the light source. The first character is configured to rotate with respect to the base between a first position facing the front direction and a second position facing the front direction. A second character is configured to be illuminated by the light source. The second character is configured to rotate with respect to the base between the first position facing the front direction and the second position facing the front direction. A rotation mechanism is configured to enable at least one of the first character and the second character to rotate between the first and the second positions.

In another embodiment the invention provides a method of positioning an illuminated sign. The method includes providing an illuminated sign having base, a first character in a first position with respect to the base and facing a front direction, and a second character in the first position with respect to the base and facing the front direction. The method further includes placing the base of the sign in a first orientation with the base facing the front direction, repositioning the base of the sign in a second orientation with the base facing the front direction, and rotating the first character with respect to the base to a second position facing the front direction using a rotation mechanism. The method further includes rotating the second character with respect to the base to the second position facing the front direction.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
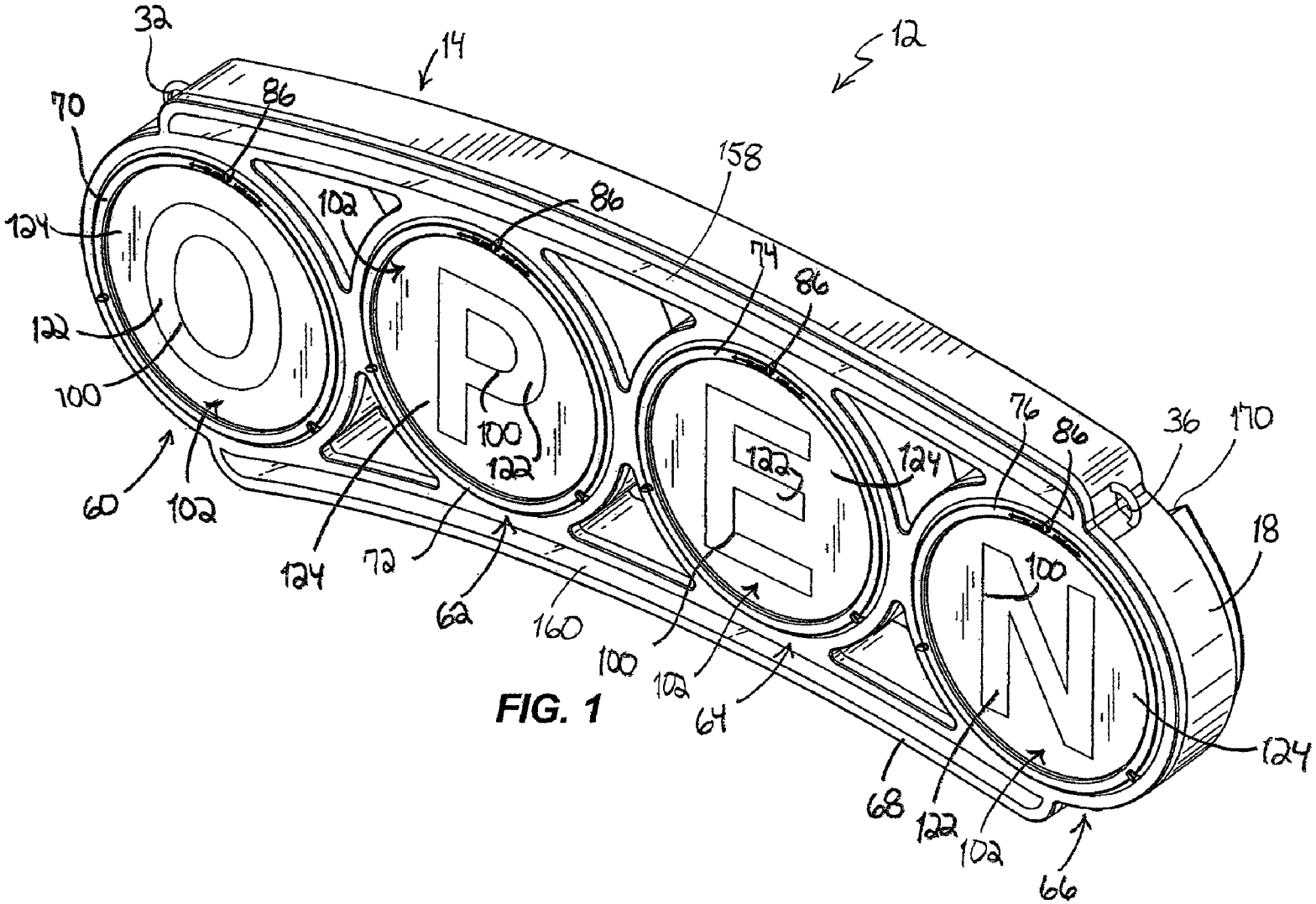
FIG. 1 is a perspective view of an illuminated sign according to one embodiment of the invention.
Figure 2:
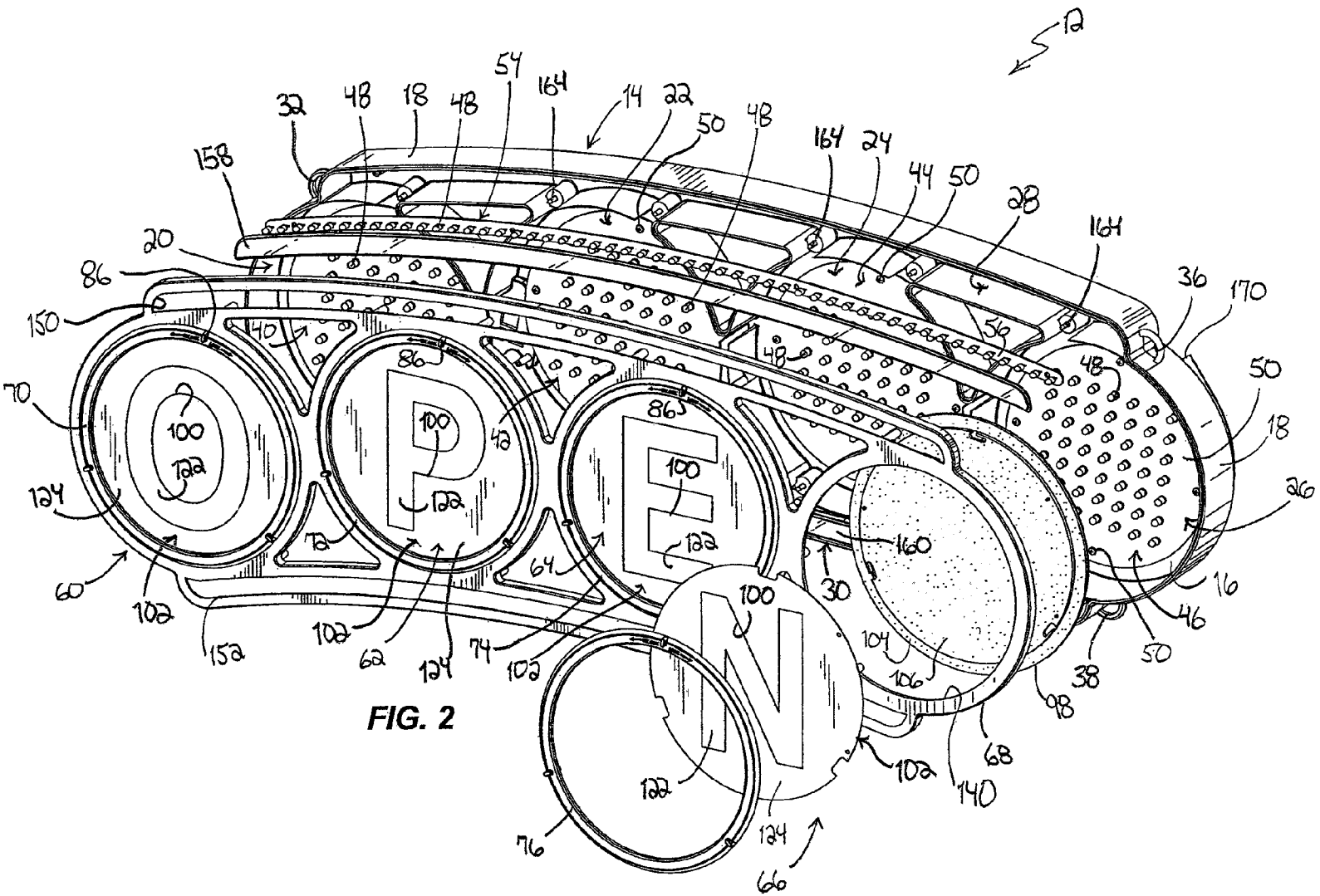
FIG. 2 is a partially exploded view of the sign of FIG. 1.
Figure 7:
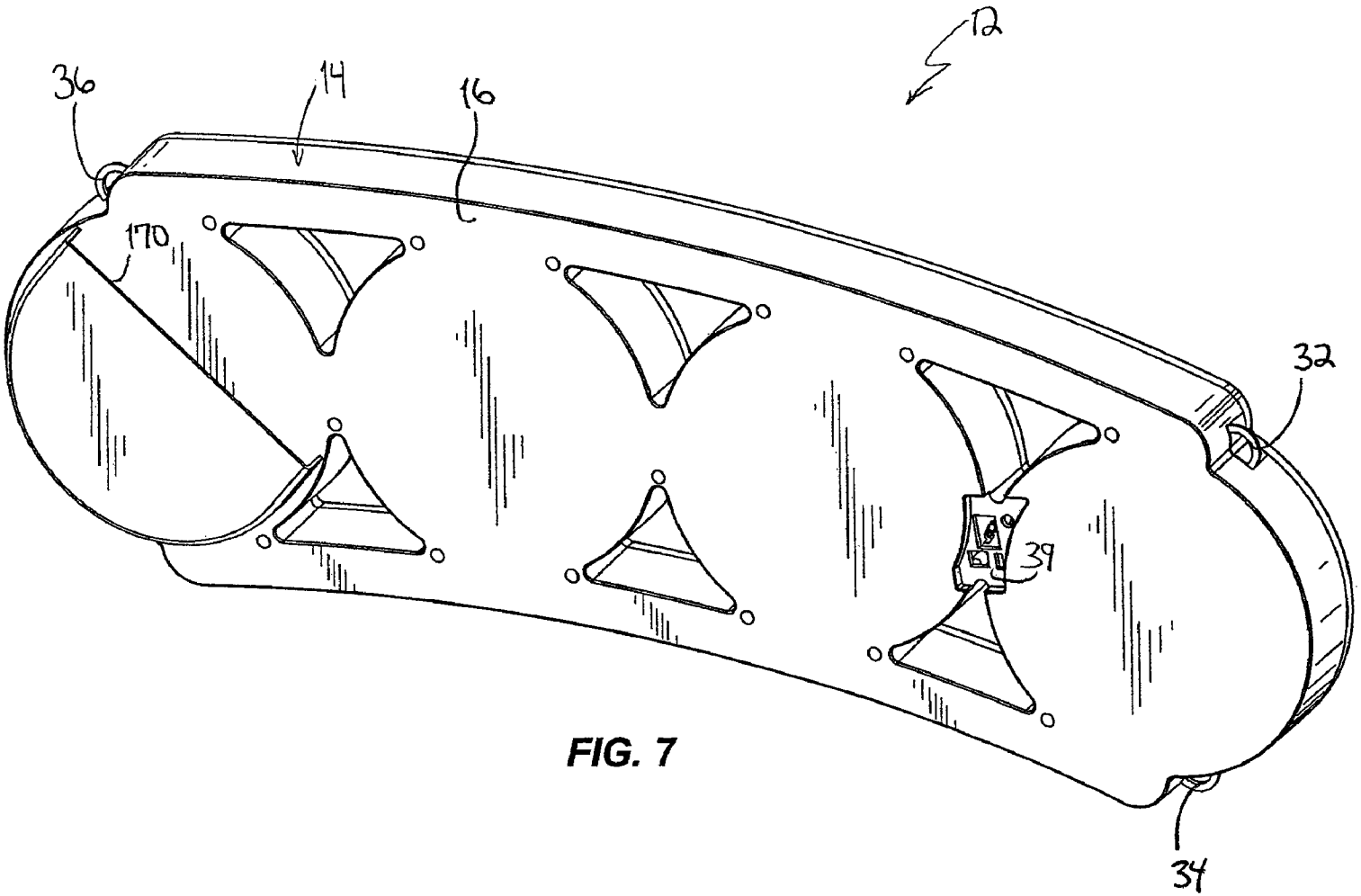
FIG. 7 is a rear perspective view of the sign of FIG. 1.

FIG. 1 illustrates an illuminated sign 12 having a base 14. Referring to FIG. 2, the base 14 includes a rear wall 16 and a plurality of sidewalls 18 that extend normal to the base of the rear wall 16 to define four generally circular cavities 20, 22, 24, 26, an upper accent cavity 28, and a lower accent cavity 30. The base 14 further includes hooks 32, 34, 36, 38 (FIG. 8) that can be utilized to hang and display the sign 12. As best seen in FIG. 7, a recess 39 is formed in the rear wall 16 of the base 14. The recess 39 receives a circuit board that includes a power switch and a power supply.

Figure 3:
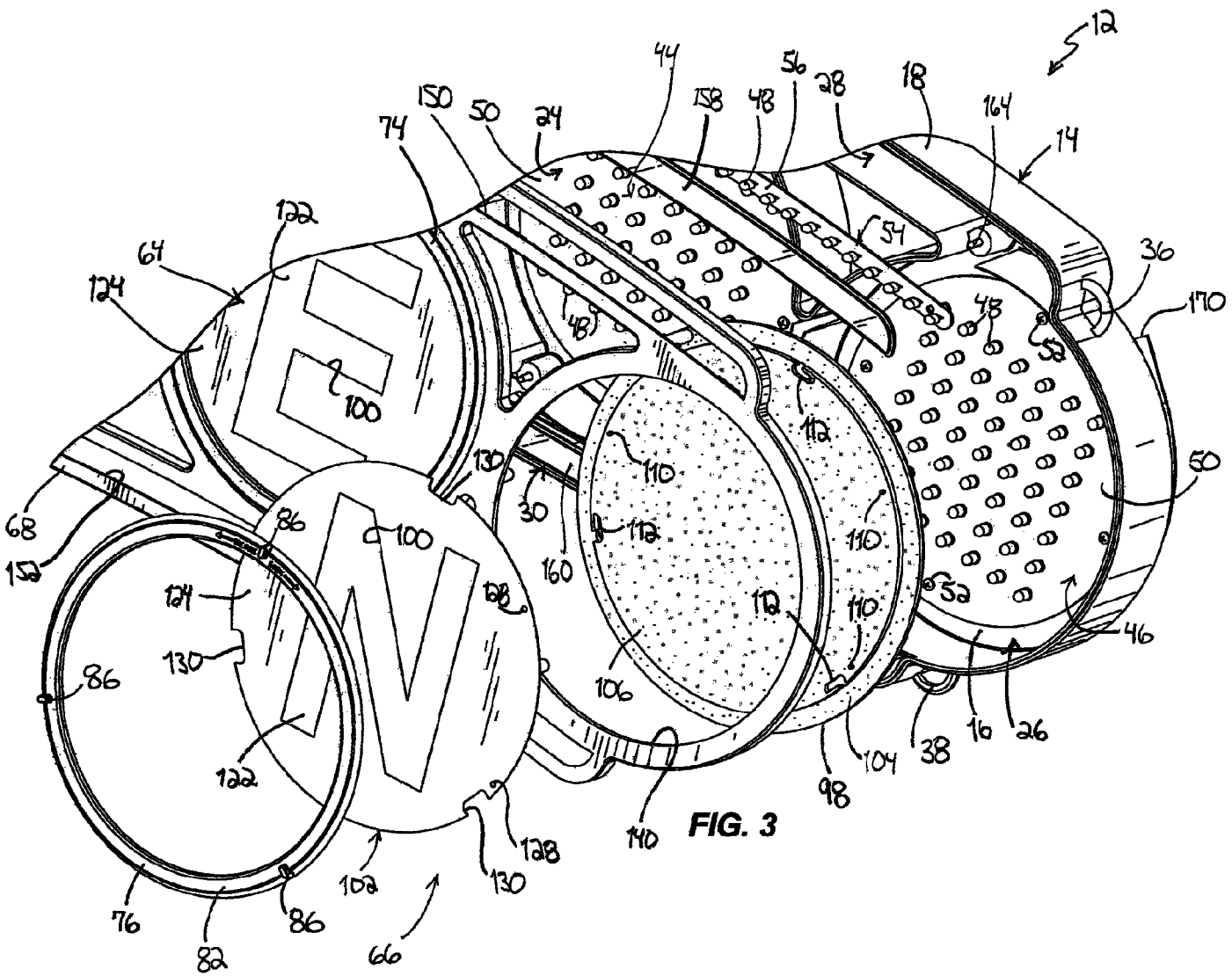
FIG. 3 is an enlarged view of a portion of FIG. 2.

With continued reference to FIG. 2, the sign 12 includes a light source, which in the illustrated embodiment includes four separate light sources 40, 42, 44, 46 that are coupled to the base 14 within cavities 20, 22, 24, 26, respectively. The illustrated light sources 40, 42, 44, 46 are generally the same, and therefore, only the light source 46 will be described in detail and like components have been given like reference numbers. As best seen in FIG. 3, the light source 46 includes a plurality of LED's 48 arranged in an array. The LED's 48 are attached to a circular substrate 50 that is coupled to the base 14 within the cavity 26 using fasteners 52. An upper accent light source 54 is coupled to the base 14 within the upper accent cavity 28. The upper accent light source 54 also includes a plurality of LED's 48 arranged in an array and the LED's 48 are attached to an elongated substrate 56. Although not illustrated, a lower accent light source, similar to the upper accent light source 54, is coupled to the base 14 within the lower accent cavity 30. The LED's 48 of the light sources 40, 42, 44, 46, 54 are connected to a power source and a switch to illuminate the LED's 48. In the illustrated embodiment, the light sources 40, 42, 44, 46, 54 use LED's, but in other embodiments, other types of light sources can be used, such as incandescent, fluorescent, halogen, and neon light sources.

Referring to FIG. 2, the illuminated sign 12 further includes translucent outputs 60, 62, 64, 66, and a rear bezel 68 that couples the translucent outputs 60, 62, 64, 66 to the base 14. Front bezels 70, 72, 74, 76 are utilized to couple translucent outputs 60, 62, 64, 66, respectively, to the rear bezel 68. Each of the front bezels 70, 72, 74, 76 are substantially the same, and therefore, only the front bezel 76 will be described in detail below and like components have been given like reference numbers.

Figure 4:
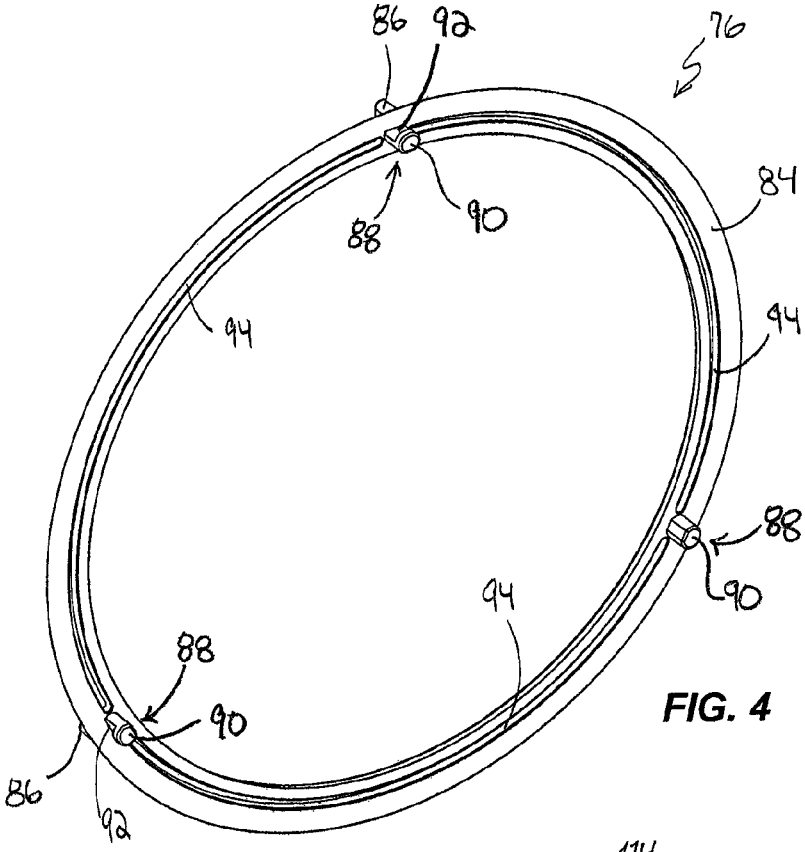
FIG. 4 is a rear perspective view of a front bezel of the sign of FIG. 1.

Referring to FIGS. 3 and 4, the front bezel 76 is generally circular and has a front side 82 and a rear side 84. Knobs or projections 86 extend from the front side 82 of the bezel 76.

Projections 88 extend from the rear side 84 of the bezel 76. The projections 88 include an enlarged end portion 90 and a relatively thin or flat inner portion 92. Slots 94 are formed on the rear side 84 of the bezel 76 and the slots 94 extend between the projections 88.

Figure 5:
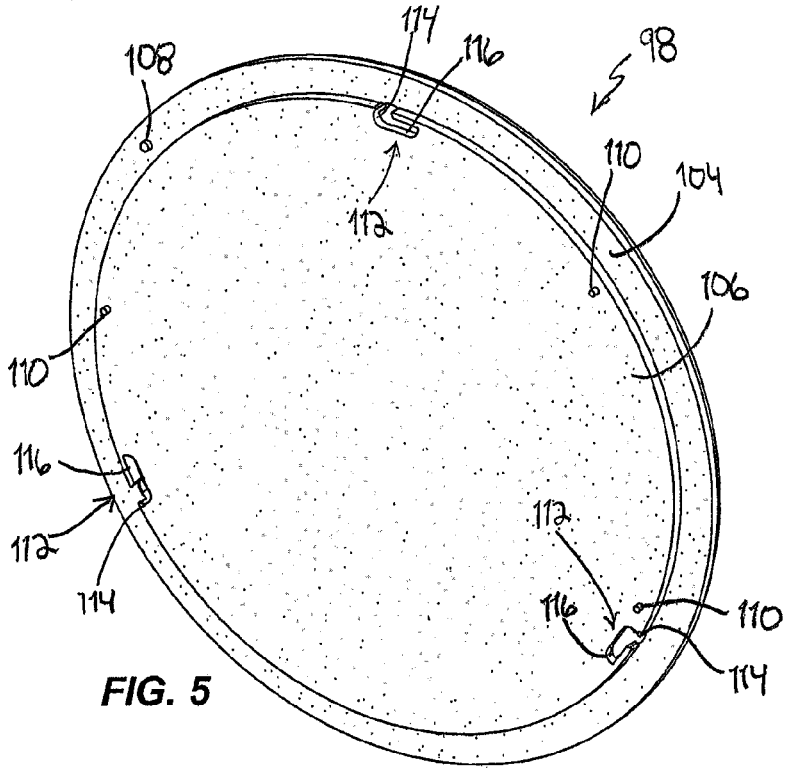
FIG. 5 is a front perspective view of a lens of the sign of FIG. 1.

Referring to FIG. 2, the translucent outputs 60, 62, 64, 66 are substantially the same, and therefore, only the translucent output 66 will be described in detail and like components have been given like reference numbers. Referring to FIG. 3, the translucent output 66 includes a lens 98 and a character 100 formed on a carrier 102. In one embodiment, the lens 98 is frosted and is a diffuser, particularly, a diffusing lens. In other embodiments, other types of diffusers can be used, and in yet other embodiments, the lens 98 may be omitted or integrally formed with the carrier 102, which can also function as diffusers. As best seen in FIGS. 3 and 5, the lens 98 is generally circular and includes a recess 104 formed around the outer periphery of the lens 98 that forms a raised inner portion 106. A pin 108 is located within the recess 104, and a plurality of pins 110 extend from the raised inner portion 106 around the periphery of the raised inner portion 106. Elongated apertures 112 extend through the lens 98 at the outer periphery of the raised inner portion 106. The apertures 112 include a relatively large end portion 114 and a relatively narrow portion 116.

With continued reference to FIG. 3, the carrier 102 includes the character 100 formed thereon. In one embodiment, the carrier 102 is formed from a velvet or matte polycarbonate substrate that also functions as a diffuser for the LED's 48. To form the character 100 on the substrate, a first translucent layer 122 is screened onto the outer surface of the substrate. Then, a second opaque layer 124, which is black in one embodiment, is screened over the first translucent layer, but the opaque layer 124 includes a cut-out section that forms or defines the character 100. Therefore, the first layer 122 is visible beneath the opaque layer 124 through the cut-out section. In one embodiment, the LED's 48 are red and the translucent layer 122 is also red, which can give a desirable appearance to the sign 12.

In the illustrated embodiment, the carrier 102 of the translucent output 66 includes the character 100 that is the letter 'N', and the other carriers 102 of the translucent outputs 60, 62, 64 include the letters 'O', 'P', 'E', respectively, such that the illuminated sign 12 is an 'OPEN' sign. In other embodiments, the carriers 102 can have other characters, such as, other letters, numbers, and symbols formed thereon. The illustrated sign includes four characters 100, and therefore four translucent outputs 60, 62, 64, 66, four cavities 20, 22, 24, 26, four light sources 40, 42, 44, 46, four front bezels 70, 72, 74, 76, and four of other features or components that will be described herein to correspond with each of the four characters 100. In other embodiments, the sign can include more or less than four characters 100, and therefore, more or less than four of the components listed above, and the number of these components may or may not equal the number of characters. For example, while the illustrated sign 12 includes four characters 100 and four lights sources 40, 42, 44, 46, in other embodiments having four characters the sign can include more or less than four light sources.

The carrier 102 is generally circular and includes apertures 128 positioned around the outer periphery of the carrier 102. Notches 130 are also formed on the outer periphery of the carrier 102.

Figure 6:
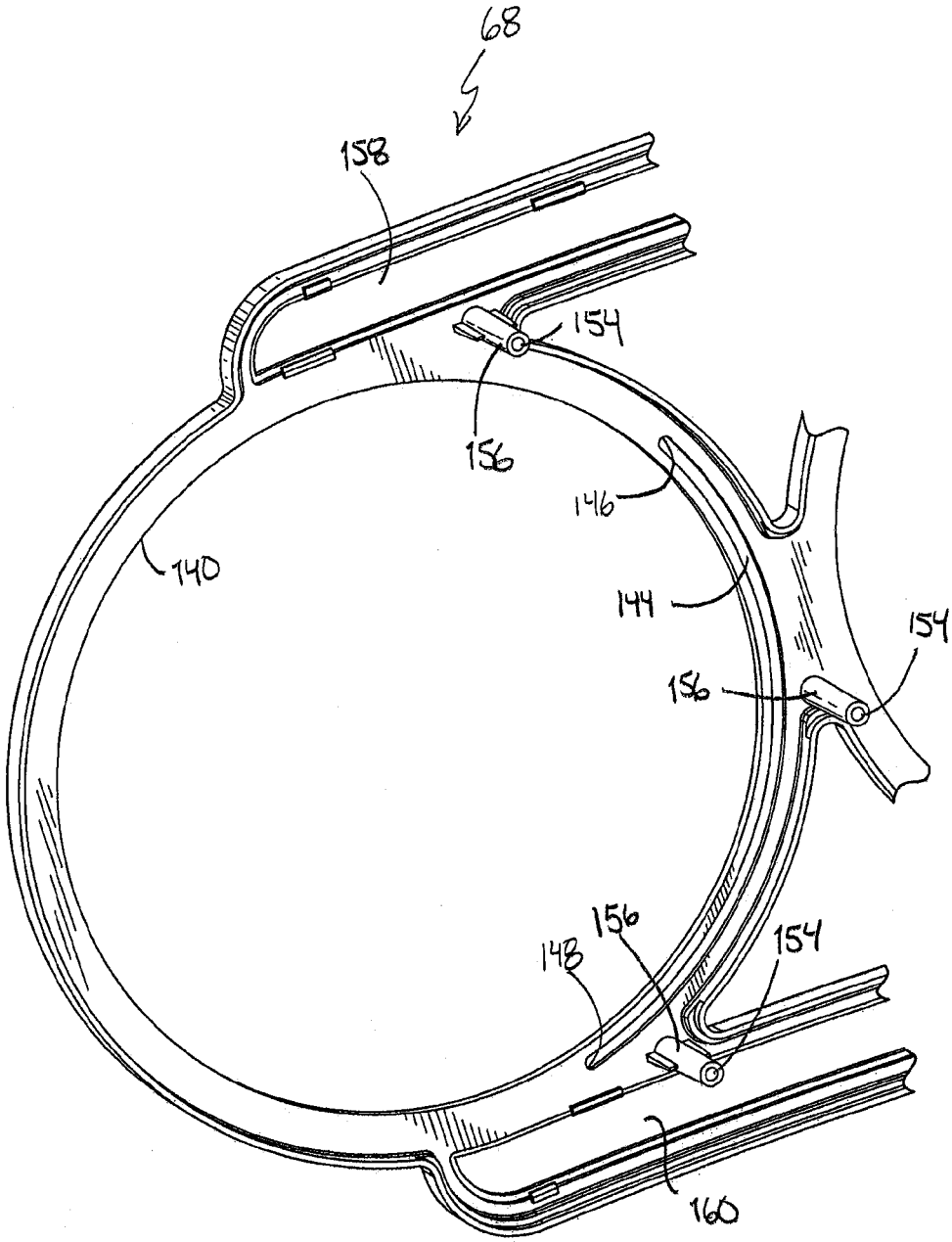
FIG. 6 is a rear perspective view of a portion of a rear bezel of the sign of FIG. 1.

Referring to FIGS. 1, 3, and 6, the rear bezel 68 includes four apertures (only the aperture 140 for the output 66 is visible in FIG. 3) for the translucent outputs 60, 62, 64, 66. As best seen in FIG. 6, a recess 144 is formed on an interior surface of the bezel 68. The recess 144 includes a first end 146 and a second end 148. The ends 146 and 148 are disposed about 90 degrees from each other around the outside of the aperture 140. Although only the recess 144 adjacent the aperture 140 is illustrated in FIG. 6, the other apertures in the bezel 68 for the outputs 60, 62, 64 also include the recess 144. The rear bezel 68 further includes an upper accent aperture 150 and a lower accent aperture 152 that extend across the top and bottom of the sign 12, respectively. Referring to FIG. 6, recesses 154 are formed in posts 156 that extend from the interior surface of the bezel 68.

Referring to FIG. 3, to assemble the sign 12, an upper accent diffuser 158 is positioned in the upper accent aperture 150 of the rear bezel 68 and a lower accent diffuser 160 is positioned in the lower accent aperture 152 of the rear bezel 68. The upper and lower accent diffusers 158 and 160, respectively, can be any suitable color and diffuse the light generated by the respective upper and lower accent light sources. The lens 98 of the translucent output 66 is coupled to the rear bezel 68 such that the raised portion 106 of the lens 98 is within the aperture 140 of the bezel 68 and the recess 104 of the lens 98 prevents the lens 98 from traveling all the way through the aperture 140. Referring to FIGS. 5 and 6, the lens 98 is coupled to the rear bezel 68 such that the pin 108 of the lens 98 is received within the recess 144 of the bezel 68. Referring to FIG. 2, the lenses 98 of the other translucent outputs 60, 62, 64 are similarly coupled to the rear bezel 68 and the rear bezel 68 is coupled to the base 14 using fasteners 164 that are received in the recesses 154 (FIG. 6).

Referring to FIG. 3, the carrier 102 of the translucent output 66 is coupled to the lens 98 of the same output 66. The carrier 102 is coupled to the lens 98 such that the pins 110 of the lens 98 extend into the apertures 128 of the carrier 102. Therefore, the pins 110 and the apertures 128 position the carrier 102 with respect to the lens 98 so that each of the notches 130 of the carrier 102 aligns with one of the apertures 112 of lens 98. Also, the pins 110 and the apertures 128 couple the lens 98 and the carrier 102 for co-rotation. After the carrier 102 is coupled to the lens 98, the front bezel 76 is coupled to the lens 98 of the translucent output 66. The bezel 76 is coupled to the lens 98 by inserting the projections 88 (FIG. 4) into the enlarged ends 114 (FIG. 5) of the apertures 112. Then, the bezel 76 is rotated, clockwise in the illustrated construction, so that the flat portion 92 of the projections 88 slide into the narrow portions 116 of the apertures 112, thereby positioning the enlarged end 90 of the pins 88 behind the lens 98 to hold the front bezel 76 and the lens 98 together. Meanwhile, the pins 110 of the lens 98 are received within the slots 94 on the rear side 84 of the bezel 76. Further clockwise rotation of the bezel 76 causes the pin 108 of the lens 98 to contact the first end 146 (FIG. 6) of the recess 144 of the rear bezel 68. In the illustrated construction, when the pin 108 contacts the end 146 of the recess 144, the character 100 is in a first vertical position.

The carriers 102 of the remaining translucent outputs 60, 62, 64 and associated front bezels, 70, 72, 74, respectively, are similarly coupled to the lenses 98 of their respective outputs 60, 62, 64 as illustrated in FIG. 1.

Figure 8:
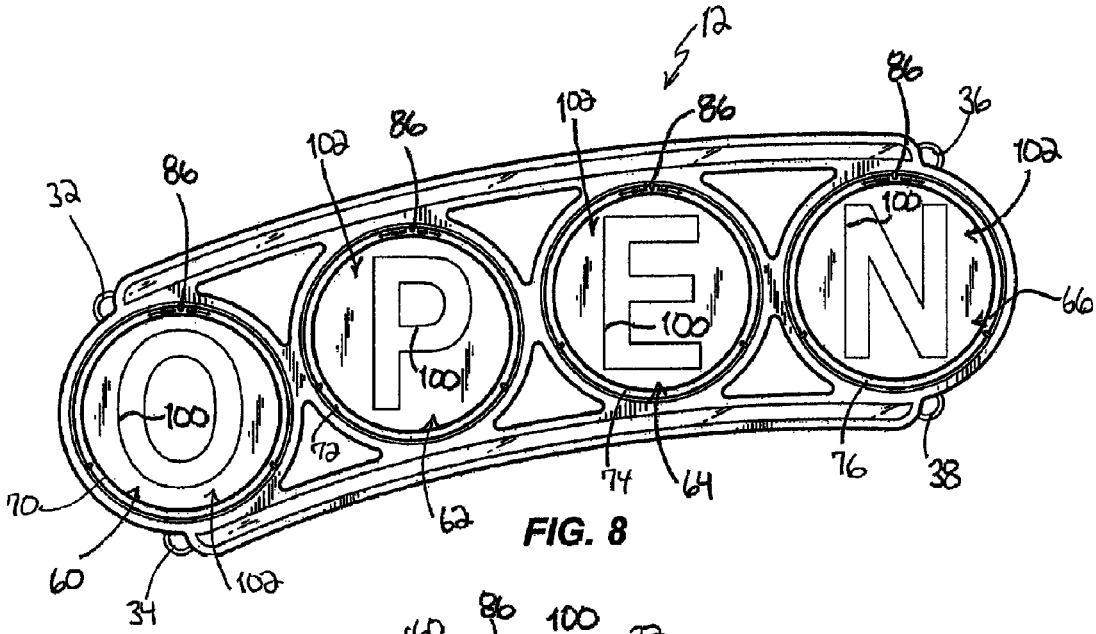
FIG. 8 is a front view of the sign of FIG. 1 in a first orientation.

With the characters 100 in the first position (FIG. 8), the sign 12 is placed in a first orientation, which is a horizontal orientation in the illustrated in embodiment. Therefore, the sign 12 can be read from left to right as illustrated in FIG. 8 and the characters 100 are in the first vertical position. The sign 12 can be placed in the horizontal orientation by hanging the sign 12 from the two hooks 32 and 36.

Figure 9:
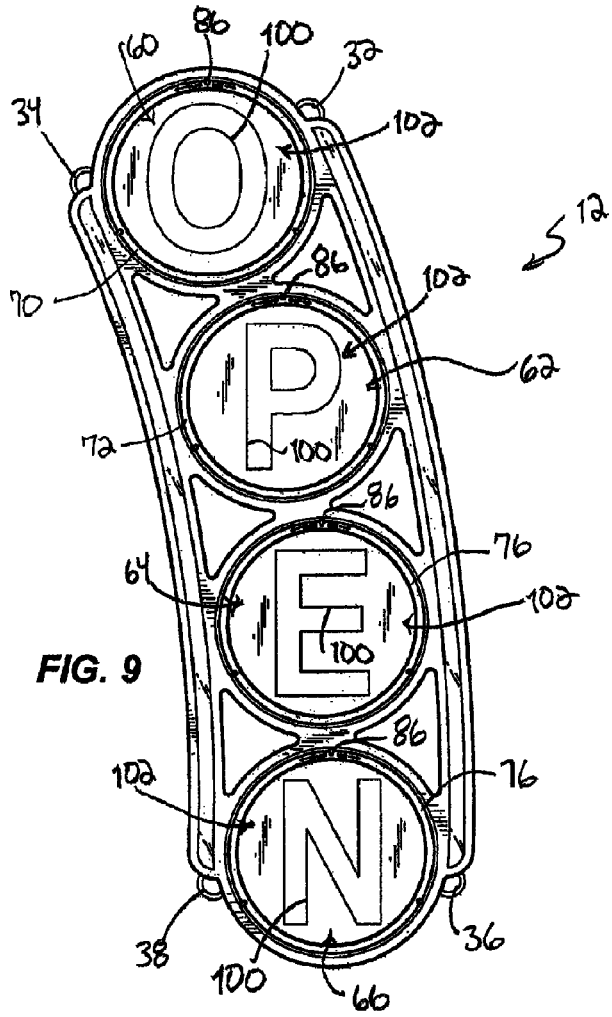
FIG. 9 is a front view of the sign of FIG. 1 in a second orientation.

Referring to FIG. 9, the sign 12 can also be repositioned to a second or vertical orientation where the sign 12, including the characters 100 and the base 14, faces the same front direction as the first or horizontal orientation of the sign 12. The sign 12 can be placed in the vertical orientation by hanging the sign 12 from the two hooks 32 and 34. When the sign 12 is repositioned to the vertical orientation, the characters 100 can be rotated to a second position with respect to the base 14 (FIG. 9). To move the characters 100 to the second position, the user uses the projections 86 of the front bezels 70, 72, 74, 76, which form a rotating mechanism. To rotate the character 100 of the fourth output 66, the user grabs the projection 86 and rotates the front bezel 76, counterclockwise in the illustrated embodiment, with respect to the base 14. Rotating the front bezel 76 also rotates the carrier 102, therefore the character 100, and the lens 98. The front bezel 76 and the lens 98 are both rotated approximately 90 degrees until the pin 108 (FIG. 5) of the lens 98 contacts the second end 148 of the recess 144 in the rear bezel 68 (FIG. 6). The pin 108 contacts the end 148 of the recess 144 to position the character 100 in the second vertical position (FIG. 9). The characters 100 of the other translucent outputs 60, 62, 64 are similarly rotated to the second vertical position. Although the illustrated sign 12 includes a rotating mechanism (e.g., projections 86 of the bezels 70, 72, 74, 76) for each character 100, in other embodiments, the sign may includes a single rotating mechanism that rotates all of the characters simultaneously. For example, all of the bezels 70, 72, 74, 76 may be interconnected by a linkage, and the linkage can pivot to simultaneously rotate all of the characters between different positions.

In the second position, the characters remain vertical so that the sign 12 can be read from top to bottom as shown in FIG. 9. Although the first and the second orientations of the illustrated sign 12 are horizontal and vertical, respectively, in other embodiments, the sign can be placed in other orientations, such as diagonal orientations.

Figure 10:
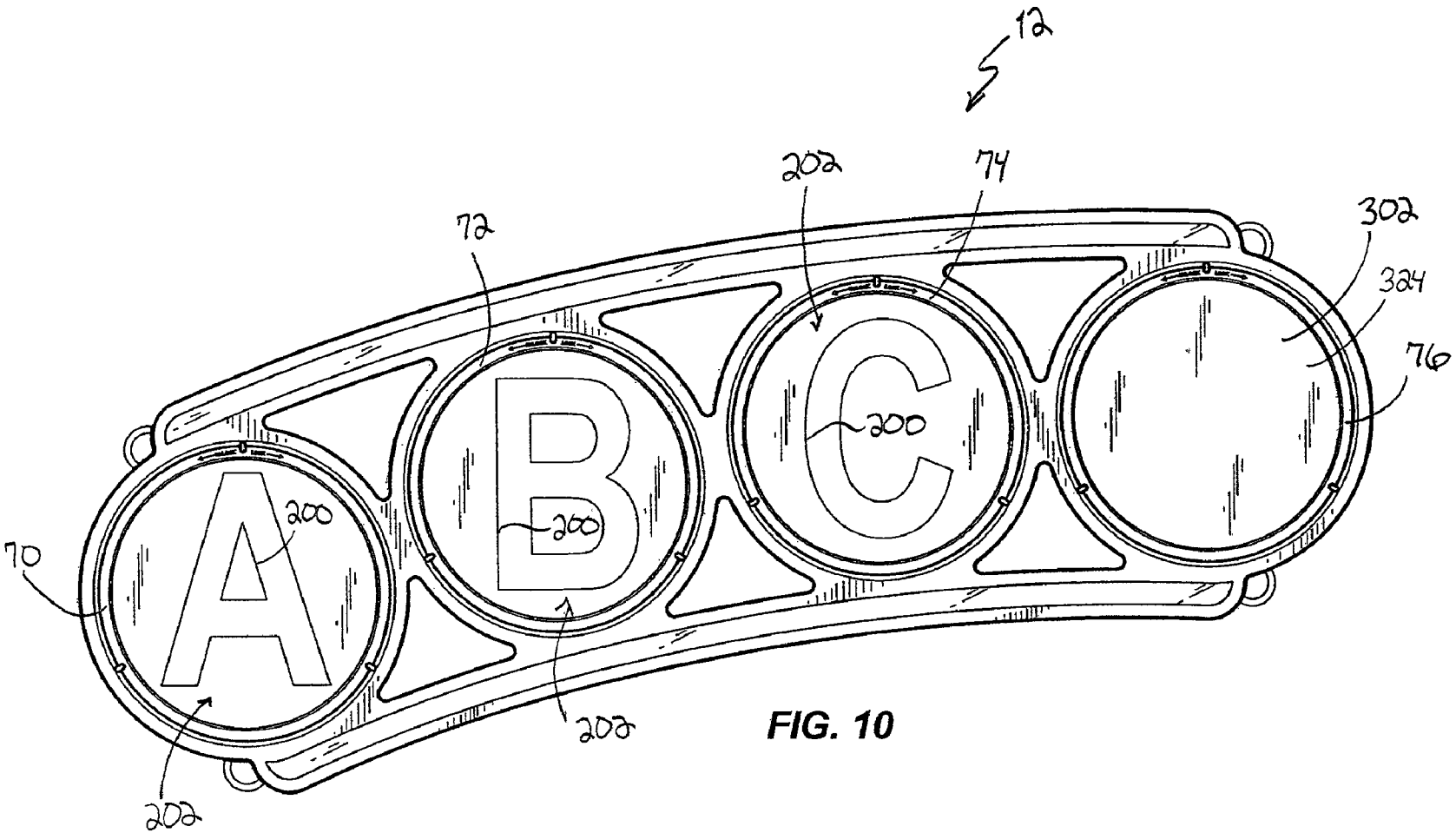
FIG. 10 is a front view of the sign of FIG. 1 including replacement characters and a blank.

Referring to FIGS. 9 and 10, the characters 100 of FIG. 9 can be replaced with different characters 200 (FIG. 10). The characters 200 are formed on carriers 202 that are interchangeable with the carriers 102. As best seen in FIGS. 1 and 7, the base 14 includes a pocket 170 to retain the carriers 102, 202 that are not being used. Referring to FIG. 3, to replace the carrier 102 of the fourth output 66 with one of the carriers 202, the user rotates the character 100 to the second position as described above. Further rotation of the front bezel 74, in the counterclockwise direction in the illustrated embodiment, causes the front bezel 74 to rotate with respect to the lens 98 because the pin 108 (FIG. 5) of the lens 98 contacts the end 148 (FIG. 6) of the recess 144 in the rear bezel 68. Therefore, the projections 88 (FIG. 4) of the front bezel 76 move back into the enlarged ends 114 of the lens apertures 112, which allows the front bezel 76 to be uncoupled from the lens 98 and the base 14. With the front bezel 76 removed, any one of the carriers 202 can be coupled to the lens 98, as discussed above in regard to carriers 102, and then the front bezel 76 is reconnected to the lens 98 as described above. Also, rather than coupling the carrier 202 having a character 200 to the lens 98, a carrier 302 (FIG. 10) that is an opaque blank can be coupled to the lens 98. The carrier 302 is essentially the same as the carriers 102, 202 except that the carrier 302 includes an opaque layer 324 that does not include a cut-out to form a character.

While the illustrated sign 12 can use up to four characters, in other embodiments, the sign can be configured for more or less than four characters. Also, while the illustrated sign includes one blank carrier 302, more than one blank carrier 302 can be supplied with the sign. Furthermore, it should be understood that the sign 12 can include several carriers 102, 202 having a variety of characters, including letter, numbers, and symbols, such that many different messages can be displayed by the sign 12.

Various features and advantages of the invention are set forth in the following claims.

What is claimed is:

1. An illuminated sign comprising:

a base configured to face a front direction and configured to be placed in a horizontal orientation and a vertical orientation when the base faces the front direction;

a first hook configured to hang the illuminated sign in the horizontal orientation;

a second hook configured to hang the illuminated sign in the vertical orientation;

a first cavity;

a second cavity;

a first light source located within the first cavity;

a second light source located within the second cavity;

a first diffuser that defines a first letter, the first diffuser rotatably coupled to the base and configured to be illuminated by the first light source; and a second diffuser that defines a second letter, the second diffuser rotatably coupled to the base and configured to be illuminated by the second light source, wherein the first and second letters are rotatable with respect to the base between a first position and a second position such that the illuminated sign is configured to read from left to right when the base is placed in the horizontal orientation and the first and second letters are in the first position and the illuminated sign is configured to read from top to bottom when the base is in the vertical orientation and the first and second letters are in the second position.

2. The illuminated sign of claim 1, further comprising, a third cavity that forms an upper accent cavity above the first and second letters when the illuminated sign is in the horizontal orientation;

a third light source located within the upper accent cavity; and an upper accent diffuser configured to be illuminated by the third light source.

3. The illuminated sign of claim 2, wherein the upper accent diffuser is fixed from movement with respect to the base.

4. The illuminated sign of claim 2, further comprising, a fourth cavity that forms a lower accent cavity below the first and second letters when the illuminated sign is in the horizontal orientation;

a fourth light source located within the lower accent cavity; and a lower accent diffuser configured to be illuminated by the fourth light source.

5. The illuminated sign of claim 1, wherein the first diffuser includes a red diffuser, wherein the second diffuser includes a red diffuser, wherein the first light source includes a red LED, and wherein the second light source includes a red LED.

6. The illuminated sign of claim 1, wherein the base includes a rear wall and a plurality of sidewalls generally normal to the rear wall, wherein the rear wall and the plurality of sidewalls define the first cavity and the second cavity.

7. The illuminated sign of claim 1, wherein the first letter and the second letter are independently rotatable between the first position and the second position.

8. The illuminated sign of claim 1, wherein the first position is approximately 90 degrees from the second position.

9. The illuminated sign of claim 1, further comprising, a first rotation mechanism to enable the first letter to rotate between the first position and the second position; and a second rotation mechanism to enable the second letter to rotate between the first position and the second position.

10. The illuminated sign of claim 9, wherein the first rotation mechanism contacts a portion of the illuminated sign to stop rotation of the first letter with respect to the base at the first and the second positions, and wherein the second rotation mechanism contacts a portion of the illuminated sign to stop rotation of the second letter at the first and the second positions.

11. An illuminated sign comprising:

a base configured to face a front direction and configured to be placed in a first orientation and a second orientation when the base faces the front direction;

a light source coupled to the base;

a first letter configured to be illuminated by the light source, the first letter configured to rotate with respect to the base between a first position facing the front direction and a second position facing the front direction;

a second letter configured to be illuminated by the light source, the second letter configured to rotate with respect to the base between the first position facing the front direction and the second position facing the front direction; and a first rotation mechanism to enable the first letter to rotate between the first and the second positions; and a second rotation mechanism to enable the second letter to rotate between the first and the second position.

12. The illuminated sign of claim 11, wherein the base includes a rear wall and a plurality of sidewalls generally normal to the rear wall, wherein the rear wall and the plurality of sidewalls define a first cavity and a second cavity, and wherein the light source is located within the first and the second cavities.

13. The illuminated sign of claim 12, further comprising, a third cavity that forms an upper accent cavity above the first and second letters when the illuminated sign is in the first orientation; and an upper accent diffuser, wherein the light source is located within the third cavity, and wherein the upper accent diffuser is configured to be illuminated by the third light source.

14. The illuminated sign of claim 13, wherein the upper accent diffuser is fixed from movement with respect to the base.

15. The illuminated sign of claim 13, further comprising, a fourth cavity that forms a lower accent cavity below the first and second letters when the illuminated sign is in the first orientation; and a lower accent diffuser, wherein the light source is located within the fourth cavity, and wherein the lower accent diffuser is configured to be illuminated by the light source.

16. The illuminated sign of claim 11, wherein the first orientation of the base is a horizontal orientation, and wherein the second orientation of the base is a vertical orientation.

17. The illuminated sign of claim 16, wherein the first position is approximately 90 degrees from the second position.

18. The illuminated sign of claim 11, wherein the first letter and the second letter are independently rotatable between the first position and the second position.

19. The illuminated sign of claim 11, wherein the first rotation mechanism contacts a portion of the illuminated sign to stop rotation of the first letter with respect to the base at the first and the second positions, and wherein the second rotation mechanism contacts a portion of the illuminated sign to stop rotation of the second letter at the first and the second positions.

20. The illuminated sign of claim 11, further comprising, a first hook configured to hang the illuminated sign in the first orientation; and a second hook configured to hand the illuminated sign in the second orientation.

* * * * *

UNITED STATES PATENT AND TRADEMARK OFFICE

CERTIFICATE OF CORRECTION

PATENT NO. : 8,371,052 B2
APPLICATION NO. : 13/350488
DATED : February 12, 2013
INVENTOR(S) : Chad Boyles, Beth Donnelly and Robert Mathson It is certified that error appears in the above-identified patent and that said Letters Patent is hereby corrected as shown below:

On the Title page, Item (56), at Reference 2,354,367: Replace the name [Duncan] with --Ford--

In the Claims
Column 8, line 37 of claim 20: Replace the word [hand] with --hook--

Signed and Sealed this
Twenty-eighth Day of May, 2013

Teresa Stanek Rea
*Acting Director of the United States Patent and Trademark Office*